US006808236B2

(12) United States Patent
Lanvers et al.

(10) Patent No.: US 6,808,236 B2
(45) Date of Patent: Oct. 26, 2004

(54) METHOD FOR PRODUCING BRUSHES AND APPARATUS FOR PERFORMING SAID METHOD

(75) Inventors: Andreas Lanvers, Bad Honnef (DE); Erwin Buchholz, Asbach (DE); Armin Seifert, Neuwied (DE)

(73) Assignee: M+C Schiffer GmbH, Neustadt/Wied (DE)

( * ) Notice: Subject to any disclaimer, the term of this patent is extended or adjusted under 35 U.S.C. 154(b) by 111 days.

(21) Appl. No.: 10/175,089

(22) Filed: Jun. 20, 2002

(65) Prior Publication Data

US 2003/0001427 A1 Jan. 2, 2003

Related U.S. Application Data

(63) Continuation of application No. PCT/EP99/10328, filed on Dec. 22, 1999.

(51) Int. Cl.[7] ..... A46D 1/04; A46D 9/00
(52) U.S. Cl. ..... 300/21
(58) Field of Search ..... 300/21, 2

(56) References Cited

U.S. PATENT DOCUMENTS 5,593,213 A * 1/1997 Meessmann ..... 300/21

FOREIGN PATENT DOCUMENTS

| | | |
|---|---|---|
| DE | 19526933 A | 1/1997 |
| DE | 19728493 A | 2/1998 |
| EP | 0078569 | 5/1983 |
| EP | 0458999 | 12/1991 |
| EP | 0736270 | 10/1996 |

* cited by examiner

*Primary Examiner*—Randall Chin
(74) *Attorney, Agent, or Firm*—Lawrence E. Laubscher, Sr.

(57) ABSTRACT

A method for producing toothbrushes by way of injection molding is provided, wherein a brush body is formed in a mold cavity, bristle filaments are connected to the brush body for forming bristles, and at least one flexible element extending substantially in parallel with the bristle filaments is preferably formed by injection onto the brush body. The contouring and/or finishing of the bristle filaments can be carried out without any impairment by the flexible cleaning elements. During the finishing operation, the flexible cleaning element is removed from the operative area of the finishing tool.

6 Claims, 3 Drawing Sheets

METHOD FOR PRODUCING BRUSHES AND APPARATUS FOR PERFORMING SAID METHOD

CROSS REFERENCE TO RELATED APPLICATION

This application is a continuation of PCT application No. PCT/EP/99/10328 filed Dec. 22, 1999.

BACKGROUND OF THE INVENTION

Field of the Invention

The present invention relates to a method for producing brushes, in particular toothbrushes, in which a brush body is formed by injection molding in a mold cavity, bristle filaments are connected to the brush body for forming bristles, and at least one flexible cleaning element extending substantially in parallel with the bristle filaments is preferably formed by injection onto the brush body.

Such a generic method is e.g. known from U.S. Pat. No. 5,628,082. Apart from the conventional bristle filaments which, being normally combined into tufts of bristles, are held in the brush body, the brush additionally comprises cleaning elements, preferably made from a thermoplastic elastomer. The cleaning elements serve not only to clean the teeth and the neighboring gums, but also to massage the gums. Moreover, the cleaning elements improve the application of dentifrices. A brush which is produced according to the generic method and serves as a toothbrush is e.g. known from WO 96/15696. In this prior-art brush, defined areas are provided one after the other for flexible cleaning elements on the one hand and for tufts of bristles on the other hand in the longitudinal direction of the toothbrush. All of the useful ends of the tufts of bristles are located in the already known brush in one plane.

Up to today such a brush has not been accepted because it does not satisfy the actual demands. As a rule, the user expects bristles provided over the whole brush head. Moreover, not only the flexible cleaning elements should have a contour, i.e. an extension of the useful ends differing from the extension of the bristle surface of the brush, i.e. that surface of the brush body that is penetrated by the bristle filaments and/or the flexible cleaning elements.

Moreover, the prior-art method is relatively complicated. First of all, a brush body comprising recesses is produced by injection molding and, after the brush body has been removed, bristle filaments are connected thereto by clips introduced into the recesses. Following a possible finishing of the useful ends of the bristle filaments the brush body is again inserted into an injection molding tool and at least one flexible cleaning element is over-molded onto the brush body.

SUMMARY OF THE INVENTION

It is the object of the present invention to develop the method for producing brushes of the above-mentioned type such that brushes which comprise a combination of flexible cleaning elements and bristle filaments can be produced without restriction of the bristle field geometry and/or the contour of the bristles, and to provide an apparatus suited for performing the method.

To achieve the above object, the above-mentioned generic method is developed according to the invention such that the useful ends of the bristle filaments are finished, the flexible cleaning element being removed at least during the finishing process from the operative area of the finishing tool.

In the method according to the invention any desired bristle field can be formed on the brush, in particular the brush head of a tooth brush. Due to the finishing operation according to the invention a contour of the bristle field can be obtained by cutting. Moreover, the bristle filaments that are cut at a later time are rounded during the finishing operation. Bristle filaments already secured as contoured bristles by over-molding to the brush body can also be rounded within the scope of the finishing treatment. In the method according to the invention the flexible cleaning elements are removed from the operative area of a finishing tool, so that the bristles provided on the brush body can be adapted to the respective demands made on its use without the flexible cleaning elements impairing the finishing operation or making it impossible. Thus a brush that is provided with tufts of bristles and flexible cleaning elements and is substantially finished can be adapted to the respective demands made on its use without such an adaptation being impaired by the configuration of the flexible cleaning elements.

In comparison with the conventional method in which a bristle carrier is first produced in a first injecting molding step and is then provided with bristles after removal from the molding tool and in which the bristle filaments are then finished and the bristle carrier is then again inserted into an injection molding tool, the brush is first completed in the method according to the invention and the bristle filaments are then finished. The method according to the invention can thus be carried out very economically. It is here of no importance whether the bristle filaments are connected by over-molding or in a conventional way, i.e. via an anchor, to the brush carrier. The method can already be simplified considerably by the measure that the two injection molding steps, first the formation of the brush body and then over-molding of the flexible elements on the brush body, are carried out directly one after the other. It is only then that the brush is transferred from an injection molding area within the process line to further stations where the bristle filaments are possibly connected in a conventional way to the brush body and the ends of the bristle filaments at the fastening side are finally finished after previous removal of the flexible cleaning element(s) from the operative area of the finishing tool. In particular in the case of a strong entanglement between the bristles formed by the bristle filaments and the flexible cleaning element(s) provided on the brush body, it is however preferred that the bristle filaments are connected to the brush body during injection molding into the mold cavity by embedding their ends provided at the fastening side and projecting into the mold cavity. In the case of a dense arrangement of the bristle filaments and the flexible cleaning elements on the brush body, a later fastening of the bristle filaments past the flexible cleaning elements is at best possible under great efforts.

In particular when elongated cleaning elements are used, the flexible cleaning element should preferably be compressed in axial direction towards the brush body. While it is known in the prior art that individual tufts of bristles of a field of bristles are deflected laterally, the flexible element(s) are compressed in the axial direction of the bristle filaments towards the brush body in the preferred embodiment of the method according to the invention. While the lateral deflection of individual or several tufts of bristles as is known from the prior art for grinding and/or shortening other tufts of bristles leads to restrictions and not all of the desired tufts of bristles of the brush can be finished, all tufts of bristles of the field of bristles can be finished in the preferred method on the whole or also selectively. The flexible cleaning element is compressed in the axial direction of the filaments using the useful ends of the bristle filaments to be treated.

The displacement of individual bristle filaments as is known from the prior art is disadvantageous insofar as it cannot be ensured in a reliable manner that predetermined bristle filaments or groups of bristle filaments, i.e. tufts of bristles, are finished in a defined way while other bristle filaments are kept away from the treatment area of the finishing tool. This drawback is reliably avoided in a preferred embodiment of the method according to the invention in that the at least one flexible cleaning element is compressed by axially supplied wires and the useful ends of the bristle filaments are guided past the wires supplied. The wires impinging on the bristle filaments in linear fashion have an almost negligible width so that the bristle filaments are pushed past the wires, whereas the flexible cleaning element, in particular in the case of an elongated extension, is seized by the at least one wire and pressed onto the brush body.

The preferred embodiment of the method according to the invention, wherein at least one wire, preferably a plurality of wires, and particularly preferably a wire grating, is supplied in the axial direction of the brush filaments to the brush body and the flexible cleaning element(s) is/are compressed in the axial direction of the bristle filaments, is preferably developed such that the bristle filaments are supported on the wires during finishing. The wires arranged above the bristle surface reduce the free bending length of the bristle filaments to be treated, thus improving a finishing of their useful ends in a predetermined way. An uncontrolled bending of the bristle filaments is in particular prevented when a close-meshed wire grating is used.

Preferably, the method according to the invention is developed such that the flexible cleaning element is gripped around on its free end for removal from the operative area of the finishing device. The displacement of individual bristle filaments which is known from the prior art cannot be carried out with the necessary accuracy. Individual bristle filaments to be displaced remain in the field of bristles and are subjected to a finishing operation in an undesired way, whereas other bristle filaments to be treated are removed from the operative area of the finishing tool.

In the preferred development of the method according to the invention, the flexible cleaning element(s) is/are gripped around at least in part in a defined way. This means that the flexible cleaning element is enclosed circumferentially at least in part. To this end gripping elements can be used that have actuable gripping surfaces. The preferred process, however, can be realized constructionally in a particularly simple way when a means is supplied towards the brush body, the means comprising at least one grip opening gripping around the flexible cleaning element. The flexible element is entrapped in said grip opening and preferably deflected laterally by operating the means which can be supplied. This reliably prevents the bristle filaments to be finished from being removed by mistake from the operative area of the finishing tool.

The object further underlying the invention, i.e. to provide an apparatus for performing the finishing operation for a brush comprising bristle filaments and flexible cleaning elements, without any limitation by the flexible cleaning elements provided on the brush body, can be achieved according to the invention in that the apparatus comprises a clamping device for the brush body and a means which is assigned to the clamping device and acts on at least one flexible cleaning element, the means being movable relative to the clamping device.

The present invention suggests, for the first time, an apparatus for finishing flexible cleaning elements and brushes comprising bristle filaments. The apparatus according to the invention comprises a means with which the flexible cleaning element can be removed from the operative area of a finishing tool, so that the finishing operation can be carried out without limitation by the flexible cleaning elements provided on the brush.

BRIEF DESCRIPTION OF THE DRAWING

Further details, advantages and features of the present invention will become apparent from the following description of the embodiments in combination with the drawing, in which drawing.

DETAILED DESCRIPTION

Figure 1:
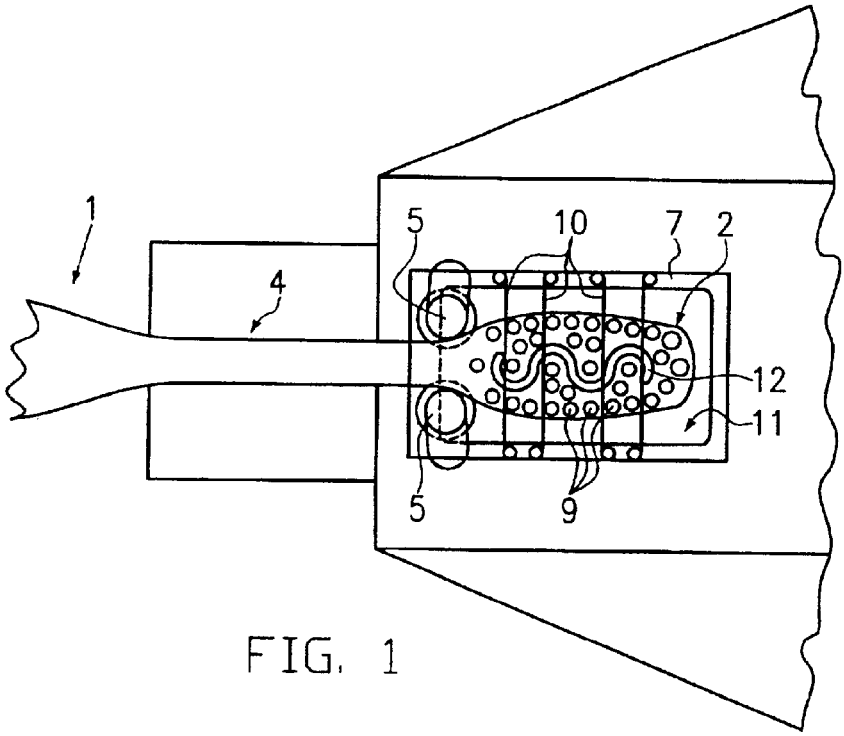
FIG. 1 is a schematic top view on a first embodiment of an apparatus according to the invention.

FIG. 1 shows a brush 1 which in the illustrated embodiment is designed as a toothbrush and the brush head 2 of which is held in a schematically illustrated clamping device 3. To this end the brush 1 is clamped and centered at a transition between the brush head 2 and a neck portion 4 by conically designed pins 5 which rest on the side surfaces and on the upper side of the brush 1.

Figure 2:
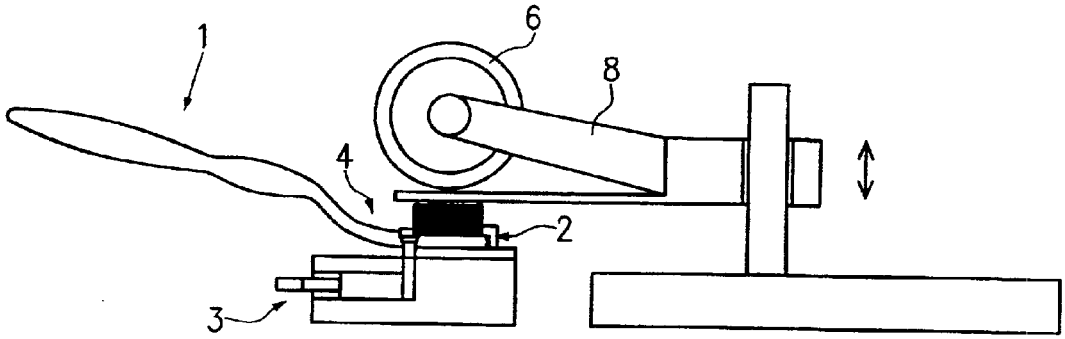
FIG. 2 is a side view of the embodiment shown in FIG. 1 in a first position of the finishing tool.
Figure 3:
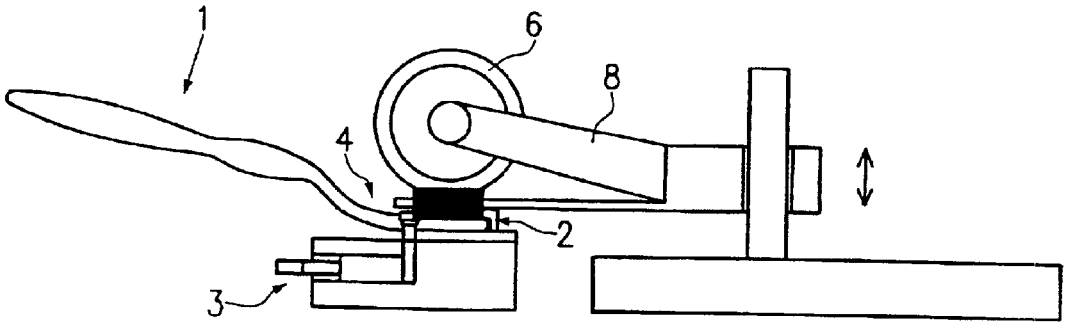
FIG. 3 is the side view shown in FIG. 2 in a second position of the finishing tool.

As can be gathered from FIGS. 2 and 3, the toothbrush 1 rests in this clamped position with its bottom side on the clamping device. Moreover, at its front end the brush head 2 is gripped over by the clamping device. In the illustrated embodiment a finishing tool shown in FIGS. 2 and 3 comprises a rotatizigly driven grinding roll 6. A frame 7 which is recessed in the area of the brush head 2 is positioned between the brush head 2 and the grinding roll 6 Said frame 7 is supported in a vertically adjustable manner together with a fork 8 carrying the grinding roll 6, namely substantially in the longitudinal direction of bristle filaments 9 formed on the brush head 2.

As shown in FIG. 1, wires 10 extend under tension from parallel longitudinal sides of the frame 7 beyond the recess 11 surrounded by the frame 7. The wires extend transversely to the longitudinal axis of the brush 1.

On its brush head 2 the clamped brush 1 comprises not only bristle filaments 9, but also a flexible cleaning element 12 extending substantially in the longitudinal direction of the brush. In the illustrated embodiment said flexible cleaning element 12 is substantially designed as a wall rising in the transverse direction in the center of the brush head 2.

The finishing operation for a brush produced by injection molding is carried out at the station shown in FIGS. 1 to 3. The manufacturing method as such is for instance known from DE 845 933, the flexible cleaning element 12 being formed on the brush head 2 in addition to the bristle filaments which are combined in the form of tufts of bristles, as is e.g. known from WO 96/15696 or U.S. Pat. No. 5,628,082. To this end, preferably thermoplastic elastomer is integrally over-molded onto the brush head 2 in a separate injection molding process.

The brush produced in this way is finished in the last processing station shown in FIGS. 1 to 3, i.e. the useful ends of the tufts of bristles are rounded by grinding. First of all, the grinding roll 6 is lowered together with the frame 7. During the lowering movement of the grinding roll 6 towards the bristle filaments 9, the bristles provided on the bristle surface of the brush head 2 as well as the flexible cleaning element pass through the recess 11 of the frame 7. During this movement the individual filaments 9 push past the wires 10, whereas the flexible cleaning element 12 is pressed towards the bristle surface of the brush head 2. In the course of the lowering movement of the grinding roll 6 together with the frame 7, the grinding roll 6 will finally act on the useful ends of the bristle filaments 9 and round the same. During this process the bristle filaments 9 are carried along in the rotational direction of the grinding roll 6 and are bent towards the wires 10 which hold the bristle filaments 9 due to their tension, thereby preventing an excessive withdrawal of the bristle filaments 9 from the grinding work.

After the grinding work has been completed, the grinding roll 6 is lifted together with the frame 7. The brush 1 which is now finished following the finishing treatment can be removed and packed.

The invention is not limited to said embodiment. The arrangement of the wires bridging the frame 7 is left at the discretion of one skilled in the art. The wires should preferably extend at an approximately right angle relative to the longitudinally designed flexible cleaning elements. Hence, the arrangement, the density and the distribution of the wires depend on the design of the flexible cleaning element(s). Moreover, a grating formed by wires extending at right angles relative to one another may be provided and arranged in the recess 11. The support of the bristle filaments during the finishing operation can be improved by a close-meshed grating.

Figure 4:
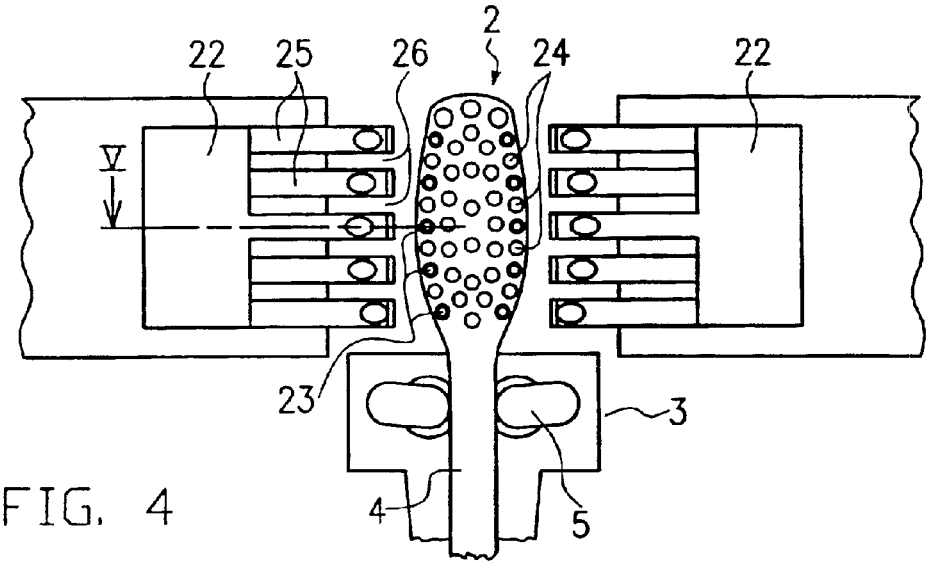
FIG. 4 is a schematic top view on a further embodiment of the apparatus according to the invention in a first position.

FIGS. 4 to 7 show a further embodiment of a finishing station. Said embodiment comprises a clamping device identical with the embodiment shown in FIGS. 1 to 3. A displacement plate 22, which is shown in its initial position in FIG. 4, is respectively provided substantially in parallel with the side surface of the brush head 2. Said displacement plate 22 forms a means with which flexible cleaning elements 23 of a substantially rod-like configuration that are arranged on the edge of the brush head 2 can be removed from the operative area of a finishing tool, here: a tool for grinding the useful ends of the bristle filaments.

In the case of the brush shown in FIGS. 4 to 7, the flexible cleaning elements 23 are exclusively provided on the outside of the brush head 2. Together with bristle bundles 24 alternating with the flexible cleaning elements 23, the flexible cleaning elements 23 define the lateral edge of the bristle surface formed on the brush head 2.

At its end facing the brush head 2, the displacement plate 22 comprises teeth 25 which extend in parallel with the longitudinal extension of the displacement plate 22. A slot 26 is respectively recessed between adjacent teeth 25. The teeth 25 are defined by displacement cheeks 27 which extend substantially at a right angle relative to the plane of the displacement plate 22. Thus, when viewed in cross section, the teeth form the base of an H-shaped or U-shaped profile whose legs are formed by the displacement cheeks 27 (cf. FIG. 5).

At a predetermined place the teeth 25 are each provided with a grip opening 28. In the illustrated embodiment each grip opening 28 is of an oval configuration. The teeth 25 are arranged in different planes and offset the different positions of the ends of the flexible cleaning elements 23 caused by different lengths.

Figure 5:
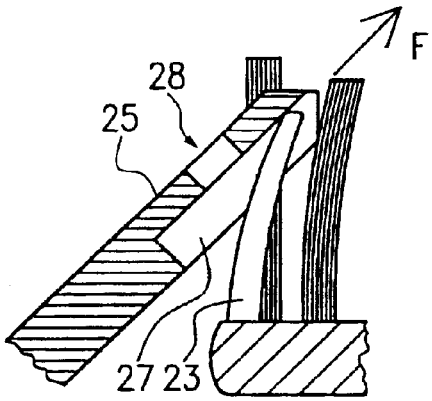
FIG. 5 is a sectional view taken along line V—V according to the illustration in FIG. 4.

The displacement plates 22 are obliquely displaceable with respect to the bristle surface of the brush head 2 that is penetrated by the tufts of bristles 24 (cf. FIG. 5). From the initial position shown in FIG. 4, the displacement plates 22 at both sides are moved towards the brush head 2 and towards the useful ends of the tufts of bristles 24 in the direction of arrow F in FIG. 5. This feed movement is carried out in oblique direction relative to the longitudinal axis of the bristle filaments. During this feed movement the individual displacement cheeks 27 surrounding the teeth 25 press the bristle filaments of the tufts of bristles 24 next to the flexible cleaning elements 23 into the slots 26. The useful ends of the flexible cleaning elements 23 first slide during the progressive feed movement of the displacement plate 22 along the bottom side of the teeth 25 that faces the brush head 2. This state is shown in FIG. 5. In the course of the feed movement of the displacement plate 22 the cleaning elements 23 will finally move in a resilient way into the oval grip openings 28.

Figure 6:
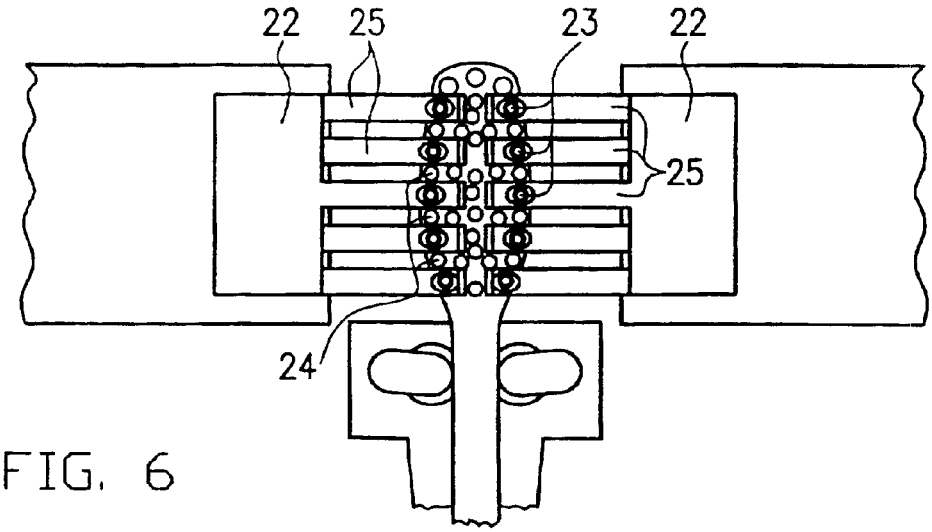
FIG. 6 shows the embodiment illustrated in FIG. 4 in a second position.
Figure 7:
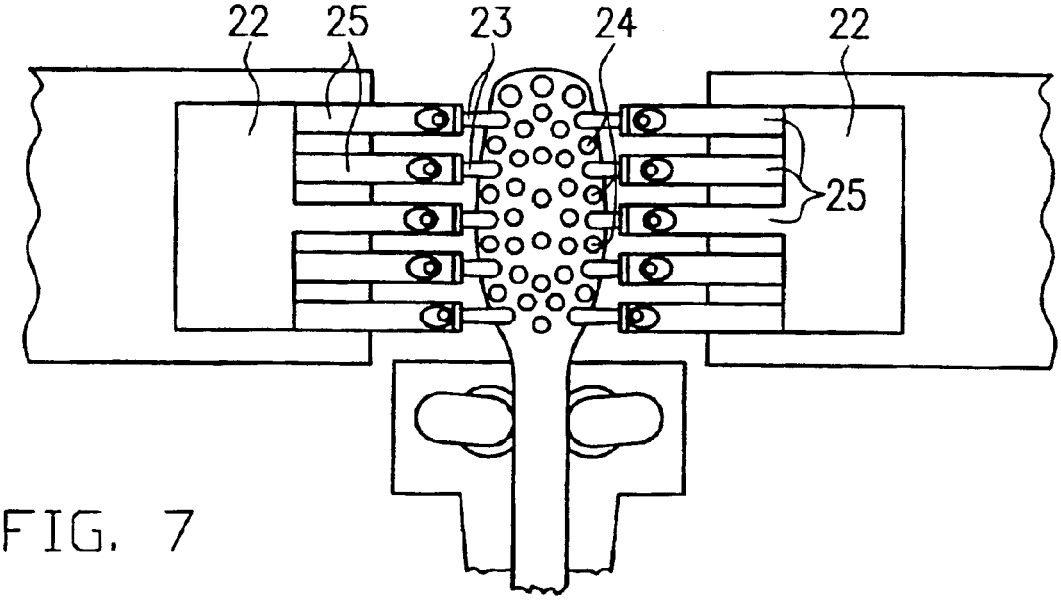
FIG. 7 shows the embodiment illustrated in FIGS. 4 and 6 in a third position.

After all tufts of bristles 24 that are arranged on the edge have thereby been displaced laterally into the slots 26 and the upper portion of the flexible deaning elements 23 has been received in the respective grip openings 28, the feed movement of the displacement plate 22 is stopped. Said end position is shown in FIG. 6.

After the flexible cleaning elements 23 have exclusively been entrapped with their upper free end in the oval grip openings 28, the displacement plate is retracted towards its initial position. The flexible cleaning elements 23 rest at least in part on the circumference of the grip openings 28 and are thereby gripped in a simple manner by the displacement plate 22. During the progressive movement of the displacement plates 22 into their initial position the flexible cleaning elements 23 are bent outwards around their longitudinal axis until the treating position shown in FIG. 7 has been reached. In said treating position the flexible cleaning elements 23 are removed from the operative area of a finishing tool (not shown). The ends of the teeth 25 at the brush side are flattened and configured to taper in an oblique manner, thus having an upper side extending substantially in parallel with the bristle surface, i.e. at a right angle relative to the filaments. Said upper side is located in the treating position shown in FIG. 6 substantially in a plane with the bristle surface of the brush head 2.

Following the grinding operation of the useful ends of the bristle filaments, the displacement plates 22 are further pushed away from the brush head 2 until the flexible cleaning elements 23 resiliently move out of the grip openings 28 in the end and return into their initial position due to their elasticity. The finished brush 1 can now be removed and packed.

What is claimed is:

1. A method for producing a toothbrush, having a head portion that caries a plurality of bristle filaments and at least one flexible resilient cleaning element, comprising:

(a) injection molding a thermoplastic material to define a toothbrush (1) including a head portion (2) having one side provided with a plurality of parallel bristle filaments (9;24) each having a free end extending therefrom;

(b) forming by injection molding at least one resilient flexible cleaning element (12; 24) on said head portion, said cleaning element having a free end normally extending from said head portion one side toward a first position in which said cleaning element free end is adjacent said bristle filament free ends;

(c) temporarily displacing said cleaning element free end toward a displaced second position in which said cleaning element free end is spaced from said bristle filament free ends;

(d) finishing said free ends of said bristle filaments, thereby to define a desired brushing profile; and (e) releasing said cleaning element free end to pennit the return thereof to said first position.

2. A method for producing a brush as defined in claim 1, wherein said cleaning element is axially compressed toward said second position.

3. A method for producing a brush as defined in claim 2, wherein said cleaning element has an axis that is normally normal to said brush head one side, said cleaning element being axially compressed by means of at least one wire that extends in a plane normal to said cleaning element axis in engagement with the extremity of said free end thereof.

4. A method for producing a brush as defined in claim 3, wherein said cleaning element comprises a wall-shaped member (12) that extends generally longitudinally of said head portion.

5. A method for producing a brush as defined in claim 1, wherein during said displacing step, said cleaning element free end is bent laterally away from said first position toward said second position.

6. A method for producing a brush as defined in claim 5, wherein said cleaning element (23) has a generally rod-like configuration, said cleaning element free end being bent toward said second position by a transversely extending tooth member (25) containing a grip opening (28) for receiving said cleaning element free end.

* * * * *